US005591114A

United States Patent [19]

Romanauskas

[11] Patent Number: 5,591,114

[45] Date of Patent: Jan. 7, 1997

[54] SWINGING BUCKET CENTRIFUGE ROTOR

[75] Inventor: William A. Romanauskas, Southbury, Conn.

[73] Assignee: Sorvall Products, L.P., Newtown, Conn.

[21] Appl. No.: 573,078

[22] Filed: Dec. 15, 1995

[51] Int. Cl.[6] ..... B04B 5/02

[52] U.S. Cl. ..... 494/20

[58] Field of Search ..... 494/16, 20, 12, 494/33, 85

[56] References Cited

U.S. PATENT DOCUMENTS

| | | | |
|---|---|---|---|
| 3,687,359 | 8/1972 | Scanlon | 494/20 |
| 3,722,791 | 3/1973 | Wright . | |
| 3,752,390 | 8/1973 | Chulay . | |
| 3,786,986 | 1/1974 | Guerrero . | |
| 3,997,105 | 12/1976 | Hayden et al. . | |
| 4,010,890 | 3/1977 | Wright . | |
| 4,010,892 | 3/1977 | Revillet et al. . | |
| 4,030,663 | 6/1977 | Conn et al. . | |
| 4,032,066 | 6/1977 | Wright . | |
| 4,141,489 | 2/1979 | Wright . | |
| 4,148,433 | 4/1979 | Bayley . | |
| 4,190,195 | 2/1980 | Chulay . | |
| 4,344,563 | 8/1982 | Romanauskas . | |
| 4,391,597 | 7/1983 | Piramoon et al. | 494/20 |
| 4,400,166 | 8/1983 | Chulay et al. | 494/20 |
| 4,435,169 | 3/1984 | Romanauskas | 494/20 |
| 4,501,565 | 2/1985 | Piramoon | 494/85 |
| 4,585,434 | 4/1986 | Cole | 494/20 |
| 4,589,864 | 5/1986 | Cole | 494/20 |
| 4,659,324 | 4/1987 | Sutton, III | 494/20 |
| 4,670,004 | 6/1987 | Sharples et al. | 494/20 |

FOREIGN PATENT DOCUMENTS

| | | | |
|---|---|---|---|
| 2814589 | 10/1979 | Germany | 494/20 |
| 271653 | 9/1989 | Germany | 494/20 |
| 207116 | 12/1967 | U.S.S.R. | 494/20 |
| 365169 | 1/1973 | U.S.S.R. | 494/20 |

*Primary Examiner*—Charles E. Cooley

*Attorney, Agent, or Firm*—Ohlandt, Greeley, Ruggiero & Perle

[57] ABSTRACT

A swinging bucket centrifuge rotor comprises a body that has a reference plane that extends generally perpendicular to a vertically extending axis of rotation. The body has at least one pair of confronting planar sidewalls each of which has a trunnion pin mounted thereon. Each trunnion pin has an axis therethrough that extends generally perpendicularly to the planar sidewall on which the pin is mounted. Each sidewall further has a generally cylindrical swinging bucket support surface thereon. Each cylindrical support surface has an axis of generation that lies in the reference plane in parallel relationship to the axis of the trunnion pin. Thus, a portion of each cylindrical support surface lies above and below the reference plane.

4 Claims, 8 Drawing Sheets

SWINGING BUCKET CENTRIFUGE ROTOR

BACKGROUND OF INVENTION

1. Field of Invention

The present invention relates to a swinging bucket centrifuge rotor.

2. Cross Reference to Related Application

Subject matter disclosed herein is disclosed and claimed in contemporaneously filed copending U.S. patent application Ser. No. 08/572,919 titled "Bucket For Use In A Swinging Bucket Centrifuge Rotor".

3. Description of Prior Art

Swinging bucket rotors are well known in the centrifuge art. In the particular class of very high speed (i.e., "ultra"-class) rotor, the rotor usually comprises a rotor body having an array of cavities located on the undersurface thereof. These cavities are adapted to receive a bucket which when installed hangs from the undersurface of the rotor body. When the rotor is accelerated to high speed the bucket swings from its rest position to a horizontal position, usually with some surface of the bucket coming to rest against a support surface on the underside of the body. This support surface is contoured to receive the bucket, thus transferring some of the load from the bucket hanger to the rotor body. U.S. Pat. No. 3,997,105 (Hayden et al.) is believed a representative example of such a rotor construction. Rotors of this type usually incorporate a spring mechanism in the hanger that allows a pin on the bucket to deflect when the bucket rotates to the horizontal position. This deflection allows the bucket to rest against the support surface of the rotor body.

This traditional type of swinging bucket rotor can sometimes cause difficulties for the clinician. Since the bucket hangs from the undersurface of the body the clinician must reach under the rotor to insert the bucket onto the rotor. This action is rendered even more difficult if the rotor is mounted to on the shaft installed in a centrifuge instrument. It is not uncommon for a bucket to be improperly installed. During operation improper installation of a bucket can cause damage to the rotor and/or, the instrument, or worse, a rotor disruption.

A different type of swinging bucket rotor developed to improve the bucket installation is disclosed in U.S. Pat. No. 4,400,166 (Chulay et al.). This type of swinging bucket rotor is known as a "top loader", owing to the fact that the buckets are installed from the top, usually by dropping onto a pin or a hanger.

One problem with both the traditional and the "top-loader" rotor is the fact that, when the bucket is in the horizontal position, the support surface on the rotor body typically only supports the portion of the bucket lying above a generally horizontal reference plane. Due to unequal support a large bending moment is applied to the rotor body support surface. The rotor body must thus be designed to accommodate this load, resulting in considerably larger and more expensive rotor.

U.S. Pat. No. 4,585,434 (Cole et al.) discloses a rotor in which the bottom surface of the bucket acts as the support surface, with the bucket resting on the structure that is usually considered the rotor windshield. However the requirement of a windshield also adds size and cost to the rotor.

In view of the foregoing it is believed advantageous to provide a top loading swinging bucket rotor that provides support for both the portion of the bucket that lies both above and below a predetermined plane, thus reducing the bending moment applied to the rotor body.

SUMMARY OF THE INVENTION

In a first aspect the present invention is directed toward a swinging bucket centrifuge rotor for use in a centrifuge instrument that comprises a body adapted for rotation about an axis of rotation extending vertically through the body. The body has a reference plane that extends through the body generally perpendicular to the axis of rotation. The body has at least one pair of confronting planar sidewalls which are circumferentially spaced apart to define a generally axially extending slot sized to receive a swinging bucket therein. Each planar sidewall has a trunnion pin mounted thereon, with each trunnion pin having an axis therethrough. Each trunnion pin is disposed a first predetermined radial distance from the axis of rotation The axis of each trunnion pin extends generally perpendicularly to the planar sidewall on which it is mounted. Each sidewall further has a generally cylindrical swinging bucket support surface thereon, the cylindrical support surface being disposed on each sidewall a second, greater, radial distance from the vertical axis. Each cylindrical support surface has an axis of generation that lies in the reference plane. Thus, a portion of each cylindrical support surface lies above and below the reference plane. The axis of generation of each cylindrical support surface may be parallel to or collinear with the axis of a trunnion pin.

In another aspect the present invention also relates to a bucket for use in a swinging bucket centrifuge rotor. The bucket in accordance with this aspect of the invention comprises a cylindrical body having a reference axis extending therethrough with a pair of planar abutments formed on the body. The abutments are diametrically disposed on the body with respect to the axis thereof. Each planar abutment surface has a planar side surface and a bottom support surface thereon. A slot is formed between a portion of each abutment and the body of the bucket. Each planar side surface has a first groove that extends generally parallel to the axis of the body and a second groove that extends generally perpendicular to the axis of the body. The first and second grooves communicate with the slot. The first and second grooves together with the slot cooperate to define a resilient spring element on each abutment. The bottom support surface on each abutment is generally cylindrical in shape and has an axis of generation that lies along the axis of the body, whereby a portion of each bottom support surface lies on opposite sides of the axis of the body.

BRIEF DESCRIPTION OF DRAWINGS

The invention will be more fully understood from the following detailed description, taken in connection with the accompanying drawings, in which.

DETAILED DESCRIPTION OF INVENTION

Figure 1A:
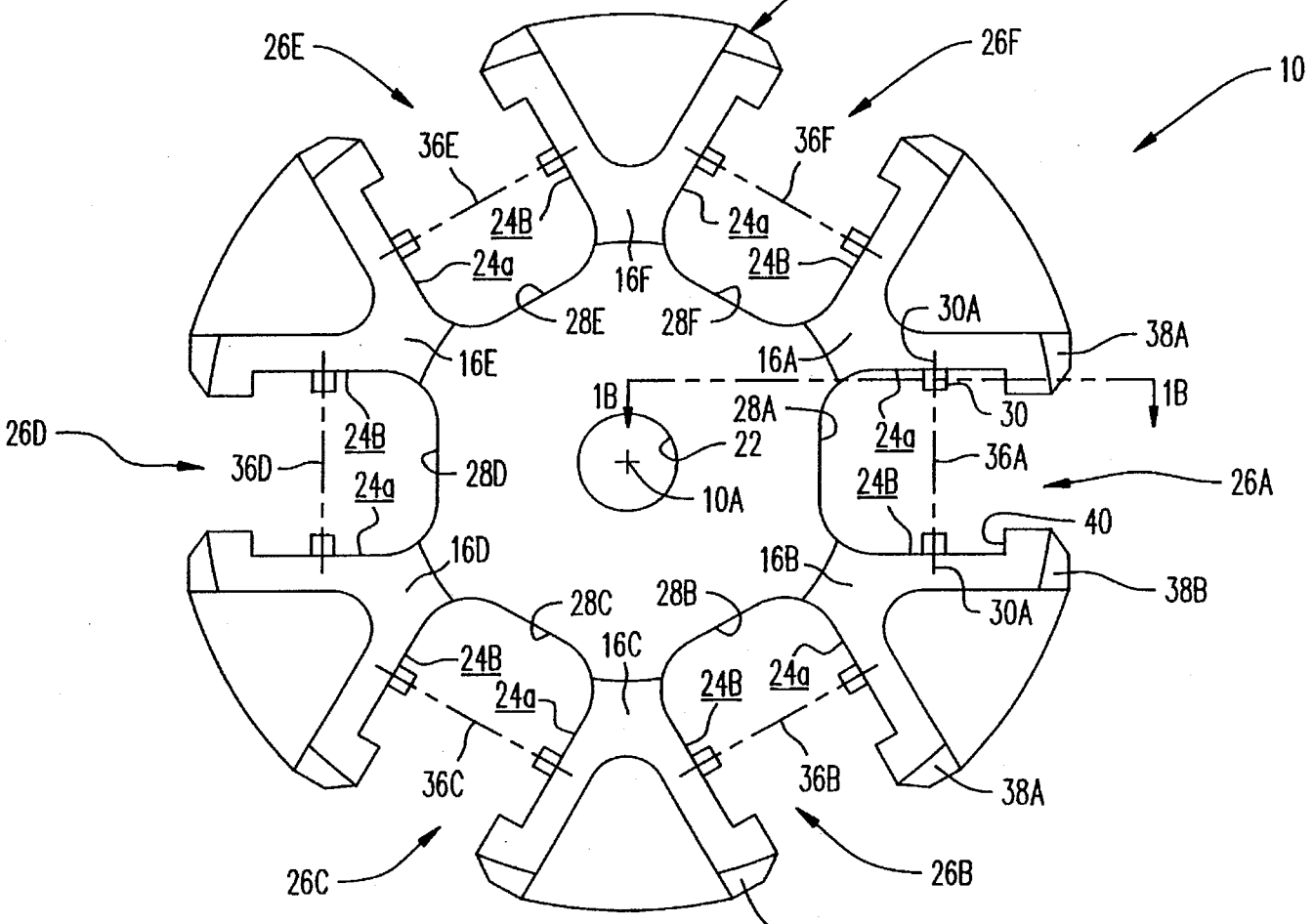
FIGS. 1A and 1B are, respectively, plan and side sectional views of a swinging bucket centrifuge rotor in accordance with a first aspect of the present invention.

Throughout the following detailed description similar reference characters refer to similar elements in all Figures of the drawings.

Figure 1B:
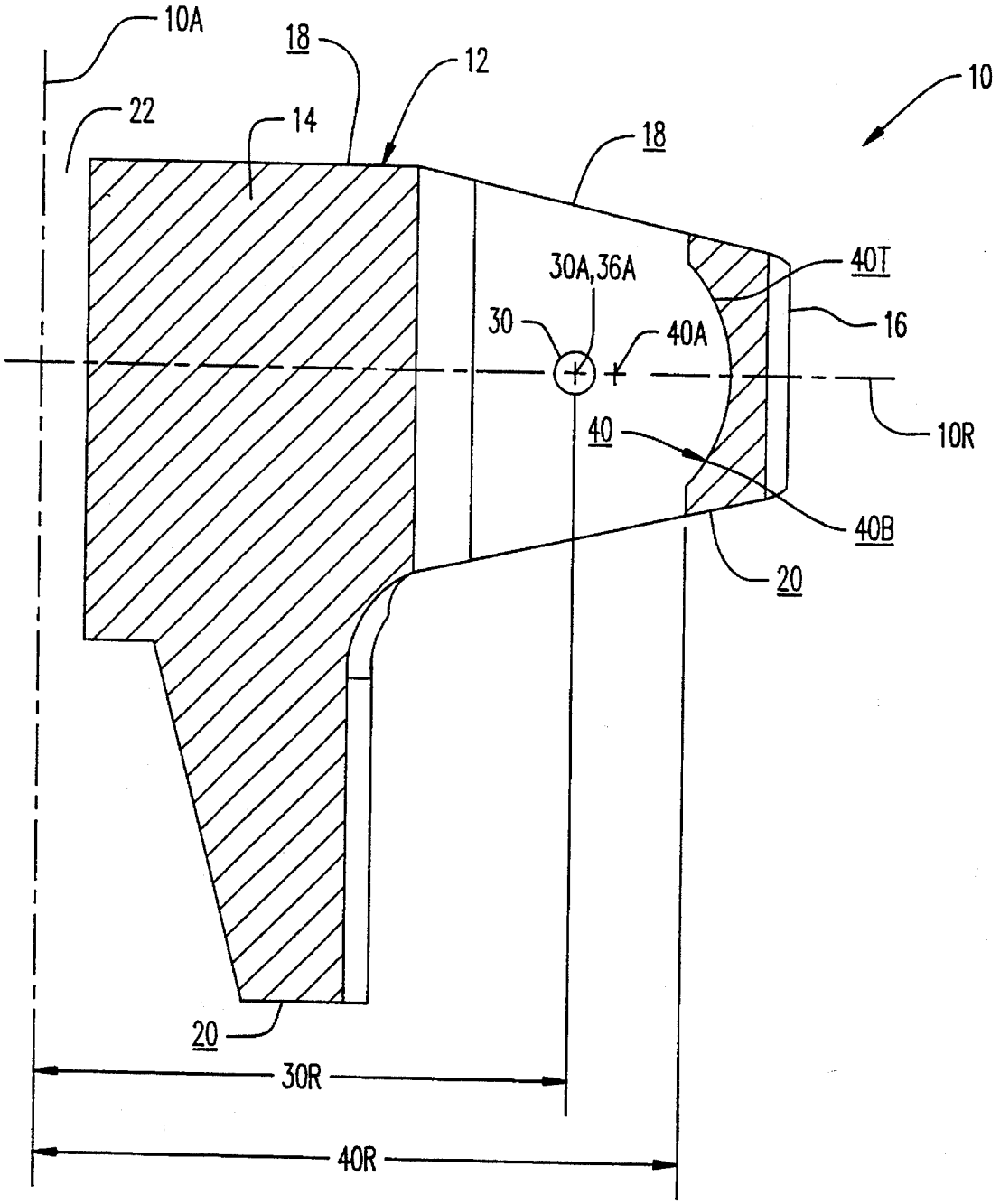

With reference to FIGS. 1A and 1B, respectively shown are a plan view and a side elevational view, partially in section, of a swinging bucket centrifuge rotor generally indicated by the reference character 10 in accordance with the present invention.

The rotor 10 is a relatively massive member formed from a strong, light weight, material, such as titanium or aluminum, by either casting, forging, or machining from solid bar stock. The various surfaces to be described herein are imparted to the rotor 10 by suitable machining operations, as should be understood by those skilled in the art. The rotor 10 is adapted for rotational motion within a centrifuge instrument about a vertical axis of rotation 10A extending therethrough.

The rotor 10 includes a body portion 12 having a central hub region 14 from which emanates a plurality of generally radially extending arms. The arms are generally indicated by the reference character 16. Although six arms 16A through 16F are illustrated, it should be understood that any predetermined convenient number of arms may radiate from the hub 14. The rotor 10 has an upper planar surface 18 and a lower surface 20 thereon. A mounting recess 22 extends through the hub 14 from the upper surface 18 to the lower surface 20. The lower portion of the mounting recess 22 is frustoconical in shape (FIG. 1B) to receive the correspondingly tapered upper end of a drive shaft (not shown) of a centrifuge instrument whereby the rotor 10 may be coupled to a source of motive force. When mounted to the shaft the axis of the shaft of the instrument aligns with the axis of rotation 10A of the rotor 10. As is best illustrated in FIG. 1B the body 10 has a reference plane 10R that extends therethrough in generally perpendicular relationship to the axis of rotation 10A. That is to say, in the conventional usage, the reference plane 10R is oriented generally horizontally when the rotor 10 is mounted for rotation about a generally vertically disposed axis of rotation 10A.

Each arm 16A through 16F carries thereon a pair of generally parallel, planar sidewalls 24A, 24B, respectively. The sidewall 24A on a given one of the arms 16A through 16F is confrontationally disposed with respect to the sidewall 24B on the next-circumferentially adjacent arm thereby to define a circumferential array of slots 26A through 26F. Each slot extends generally axially through the rotor, (i.e., substantially parallel to the axis of rotation 10A). The paired sidewalls 24A, 24B on respective circumferentially adjacent arms 16 are circumferentially spaced apart sufficiently to accommodate a swinging bucket sample container 100 that will be described more fully herein. The radially inner ends of the paired sidewalls 24A, 24B are joined by a scalloped contoured surface 28A through 28F which affords sufficient head space to accept the head of the bucket 100 to be described when the same swings from its rest toward its operating position.

Each planar sidewall 24A, 24B in each confronting pair of sidewalls has a trunnion pin 30 mounted thereon. Each trunnion pin 30 itself has an axis 30A therethrough. The axis 30A of each trunnion pin 30 extends generally perpendicularly to the planar sidewall 24A, 24B, as the case may be, on which it is mounted. The axes 30A of the trunnion pins disposed on circumferentially adjacent arms lie on a common line 36A through 36F, as shown in FIG. 1A. As will be developed and discussed herein (FIGS. 3A through 3D) these lines 36A through 36F align with a swing axis 100S on which a bucket 100 depending from the paired trunnion pins 30 swings as the bucket 100 displaces from its first, rest, position (FIG. 3A) to its second, operating position (FIG. 3D). The trunnion pin 30 on each arm is located a predetermined radial distance 30R (FIG. 1B) from the axis of rotation 10A. The axis 30A of each of trunnion pin 30 preferably lies on the reference plane 10R (FIG. 1B).

The radially outer end of each arm 16A through 16F has a generally circumferentially extending finger 38A, 38B thereon. The finger 38A on a given one of the arms 16A through 16F is confrontationally disposed with respect to the finger 38B on the next-circumferentially adjacent arm. The paired confronting fingers 38A, 38B on respective circumferentially adjacent arms 16 partially close the slots 26A through 26F defined by the sidewalls on which the fingers are disposed. However, the ends of the fingers 38A, 38B are circumferentially spaced apart sufficiently to permit the main cylindrical portion of the body of a swinging bucket sample container 100 to swing outwardly as the bucket moves toward its operating position. Each finger 38A, 38B has a generally cylindrical swinging bucket support surface thereon 40 thereon. Each support surface 40 has a predetermined radius of curvature associated therewith. The support surfaces 40 are disposed on each sidewall 24A, 24B (as the case may be) a second, greater, radial distance 40R from the vertical axis 10A (FIG. 1B).

As is made clear in FIG. 1B each cylindrical support surface 40 has an axis of generation 40A that lies in the reference plane 10R. The axis of generation 40A may be disposed in parallel relationship to the axis 30A of the trunnion pin 30 that extends from the sidewall on which the support surface is mounted. In the most preferred instance the axis 30A of each trunnion pin lies in the reference plane 10R in collinear relationship with the axes of generation 40A of the support surfaces 40.

As is apparent from FIG. 1B the above-described relationship between the axis of generation 40A of each cylindrical support surface 40 and the reference plane 10R of the rotor 10 thereby subdivides the surface 40 into a portion 40T that lies axially above the reference plane 10R and a portion 40B that lies axially below the reference plane (both with respect to the axis of rotation 10A). The advantage afforded by this disposition of the support surfaces 40 will become more clear herein.

Figure 2A:
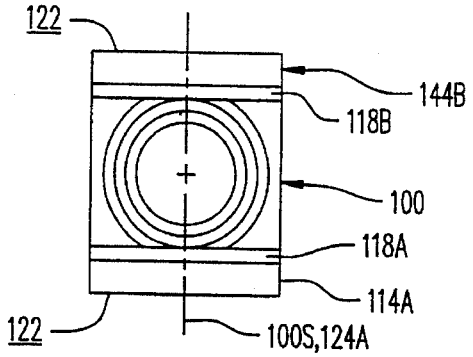
FIGS. 2A, and 2B are, respectively, a plan and a side elevational view, partially in section.
Figure 2B:
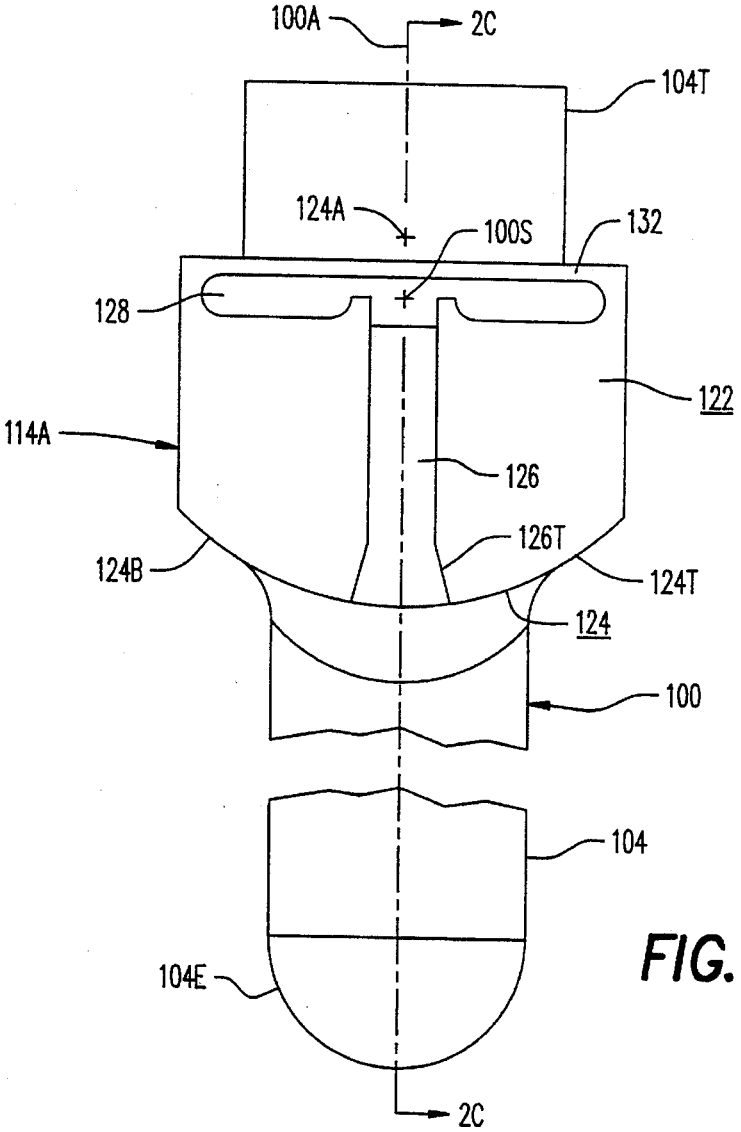
Figure 2C:
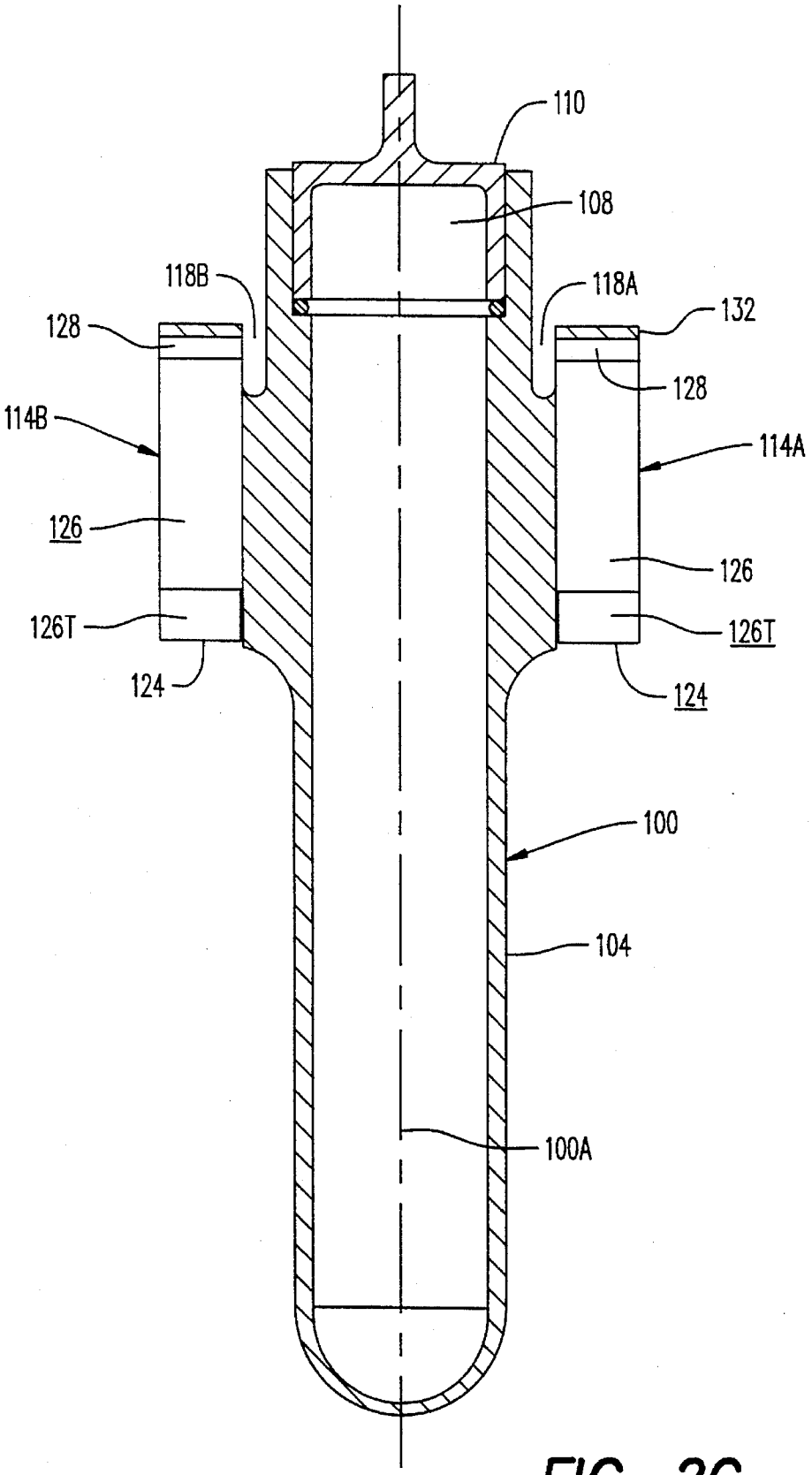
FIG. 2C is a sectional view of a bucket for use in the swinging bucket rotor of FIG. 1A and 1B.

In another aspect the present invention is directed toward a bucket generally indicated by the reference character 100 for use in a swinging bucket centrifuge rotor. The bucket is illustrated in FIGS. 2A through 2C herein. In accordance with the present invention the bucket 100 comprises a generally cylindrical body portion 104 through which a longitudinal reference axis 100A of the bucket 100 extends. The open top 104T of the body 104 defines the upper, or top, end of the bucket 100. The closed lower end 104E of the body 104 may be spherical, conical, or otherwise configured. The bucket 100 also has a predetermined swing axis 100S defined therethrough. The swing axis 100S is that axis about which the bucket 100 swings as it moves from its first, rest, position (FIG. 3A) to its second, operating, position (FIG. 3D). Preferably, the swing axis 100S perpendicularly intersects the longitudinal axis 100A of the bucket 100. The body 104 is hollow to define a central, sample container-receiving cavity 106 therein. The mouth 108 of the cavity 106 may be threaded (if desired) to receive a cap 110 (FIG. 2C). The cavity 106 may be otherwise closed in any suitable manner.

The swinging bucket 100 includes a pair of ear-like abutments 114A, 114B formed on the body portion 104. As is best seen in FIGS. 2A and 2C a slot 118A, 118B each serves respectively to separate the axially upper portion of each of the abutments 114A, 114B from the main body of the bucket 100. The purpose of the slots 118A, 118B shall become more clear hereafter. Each abutment 114A, 114B has a planar exterior lateral surface 122 and a generally cylindrical bottom support surface 124 thereon. The planar exterior lateral surface 122 is arranged to lie perpendicular to the swing axis 100S. The cylindrical bottom support surface. 124 has a radius of curvature that is equal to the radius of curvature of the support surface 40.

As is best seen in FIG. 2B the planar exterior lateral surface 122 of each abutment has a first groove 126 and a second, intersecting, groove 128 formed therein. The first groove 126 extends generally parallel to the longitudinal axis 100A of the bucket 100 while the second groove 128 extends generally perpendicularly to that axis. The lower portion of the first groove 126 has tapered lead-in surfaces 126T thereon. The upper portion of the first groove 126 and the entirety of the second groove 128 communicate with the slot 118 lying adjacent to the abutment 114A, 114B in which the grooves are formed, as the case may be. As such, the first and second grooves 126, 128, together with the slot 118, cooperate to define in each abutment 114A, 114B a resilient spring element 132.

The axis of generation 124A of the generally cylindrical bottom support surface 124 on each abutment 114A, 114B lies along the longitudinal axis 100A of the of the bucket 100 in perpendicular relationship with respect thereto. Accordingly, the cylindrical bottom support surface 124 is subdivided into portions 124T, 124B (FIG. 2B) that lie on respective sides of the axis 100A of the bucket 100. As viewed in FIG. 2B the portion 124T of the surface 124 is illustrated as lying to the right of the longitudinal axis 100A of the bucket 100, while the portion 124B of the surface 124 is illustrated as lying on the left of the longitudinal axis 100A. The advantage afforded by this configuration of the support surface 124 will also become more clear herein. The axis of generation 124A may be disposed parallel to or collinear with the swing axis 100S. Based upon considerations which are more fully discussed herein the axis of generation 124A may be disposed either "above" the swing axis 100S, in which case the axis of generation 124A lies closer to the top end 104T of the bucket 100 than does the swing axis 100 S. Alternatively, the axis of generation 124A may be disposed "below" the swing axis 100S, in which case the swing axis 100S lies closer to the top end 104T of the bucket 100 than does the axis of generation 124A.

—o—O—o—

Having described the structural details of both the rotor 10 and the swinging bucket 100 for use therein, the manner in which these members are used together may be understood from FIGS. 3A to 3D.

Figure 3A:
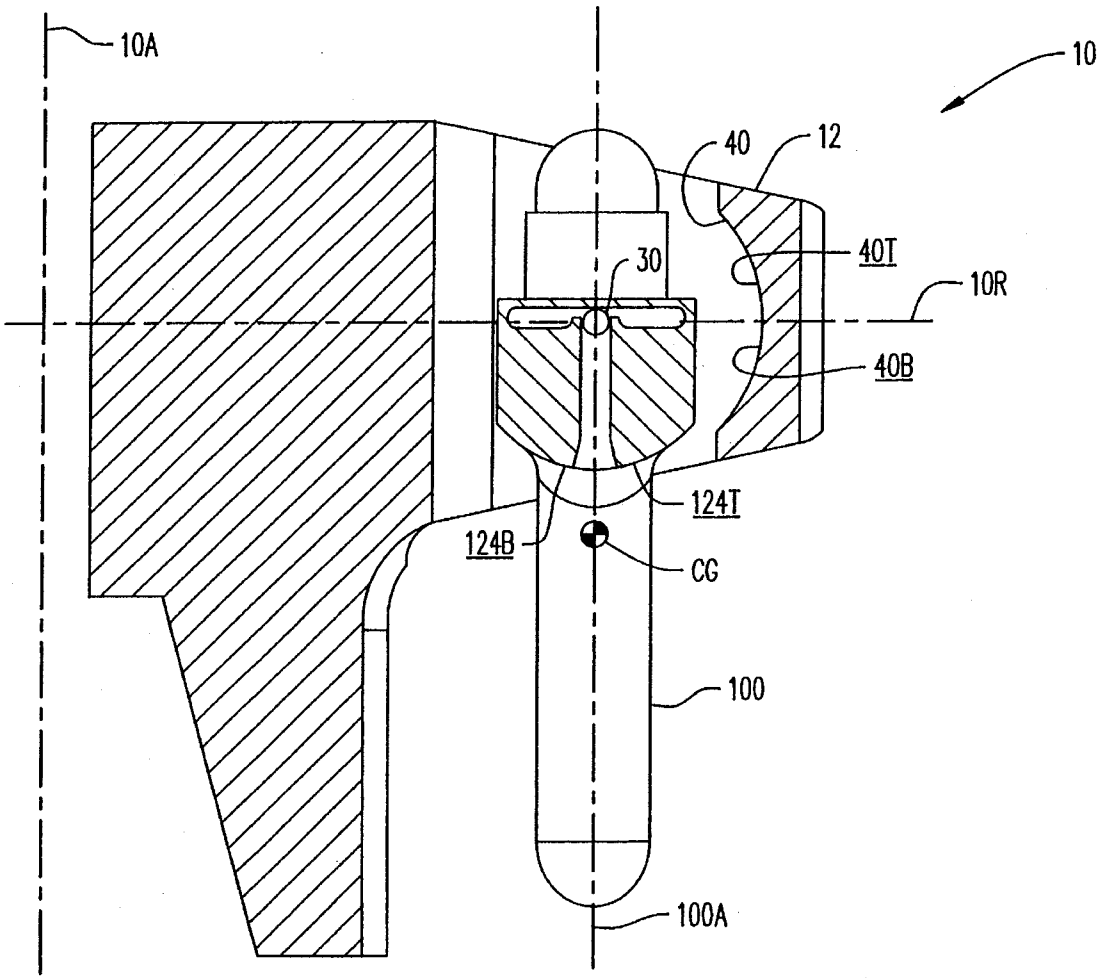
FIGS. 3A through 3D are side sectional views of the bucket shown in FIGS. 2A through 2C in use with a rotor as shown in FIGS. 1A and 1B.

In FIG. 3A the rotor 10 and the bucket 100 are shown while at rest. The rotor is assumed to be mounted to the shaft of a centrifuge instrument (not shown) such that the axis 10A of the rotor 10 is disposed in a generally vertical disposition with respect to an external datum. The bucket 100 is installed on the rotor 10 in the position shown by lowering the bucket 100 into one of the slots 26 such that the trunnion pin 30 on each of the confronting sidewalls 24A, 24B that define the slot 26 is received within a groove 126 defined on an abutment 114A, 114B of the bucket 100. The bucket 100 is lowered until the undersurface of the resilient element 132 rest against corresponding trunnion pin 30. The tapered lead-in surfaces 126T assist in this installation. The bucket 100 is thus supported in a depending relationship from the paired trunnion pins 30 by the resilient elements 132 on each abutment 114A, 114B. When in the rest position the longitudinal axis 100A of the bucket 100 lies perpendicular to the reference plane 10R of the rotor 10. The swing axis 100S of the bucket 100 aligns with the line 36 and the collinear axes 30A.

Figure 3B:
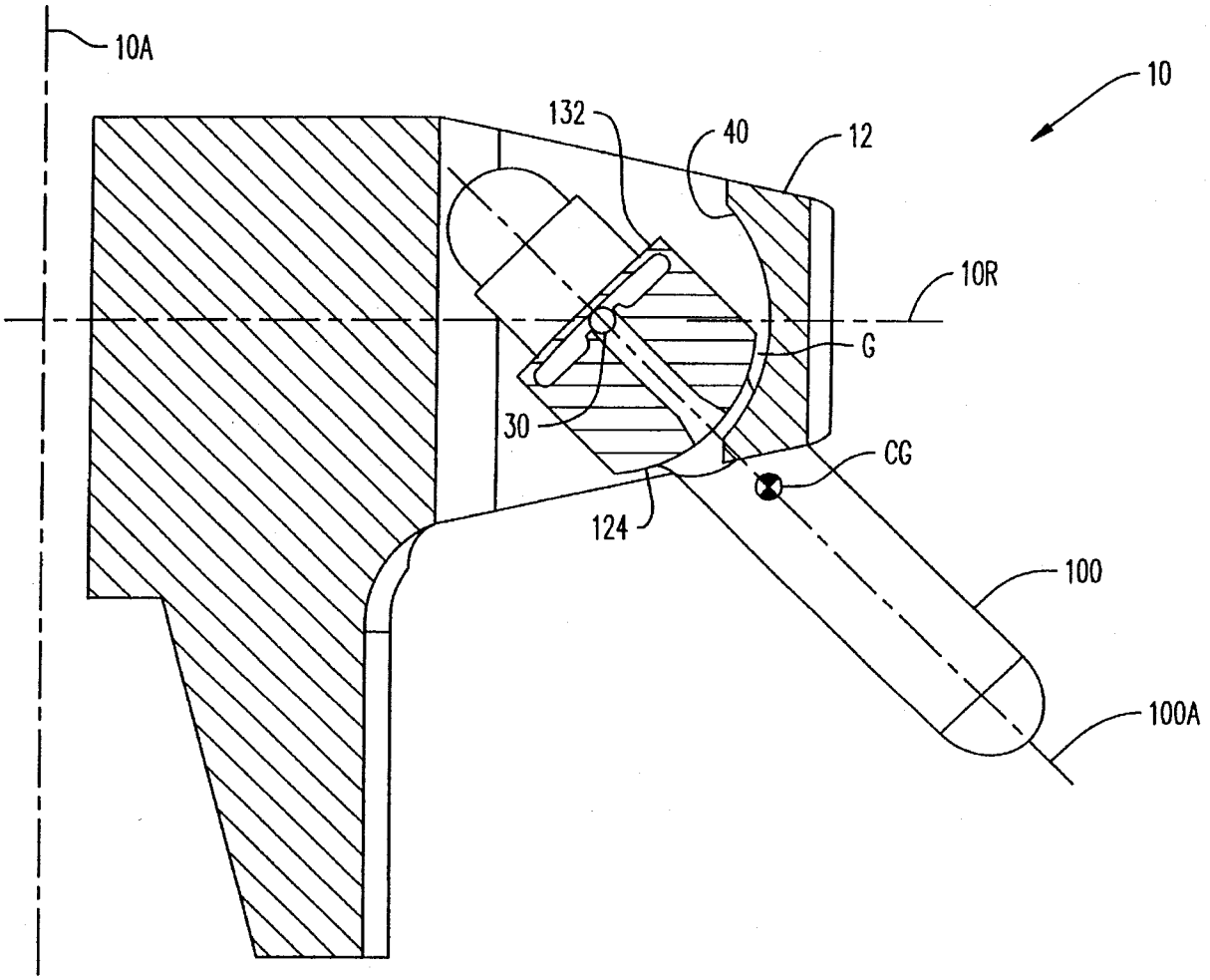

FIG. 3B illustrates the relationship between the rotor 10 and the bucket 100 as the rotor accelerates to a relatively low rotational speed. Since the center of gravity CG of the bucket 100 (and any liquid sample carried therein) lies below the swing axis 100S the bucket 100 starts to swing (about the swing axis 100S) from its rest position (FIG. 3A) toward its operating position (FIG. 3D).

Figure 3C:
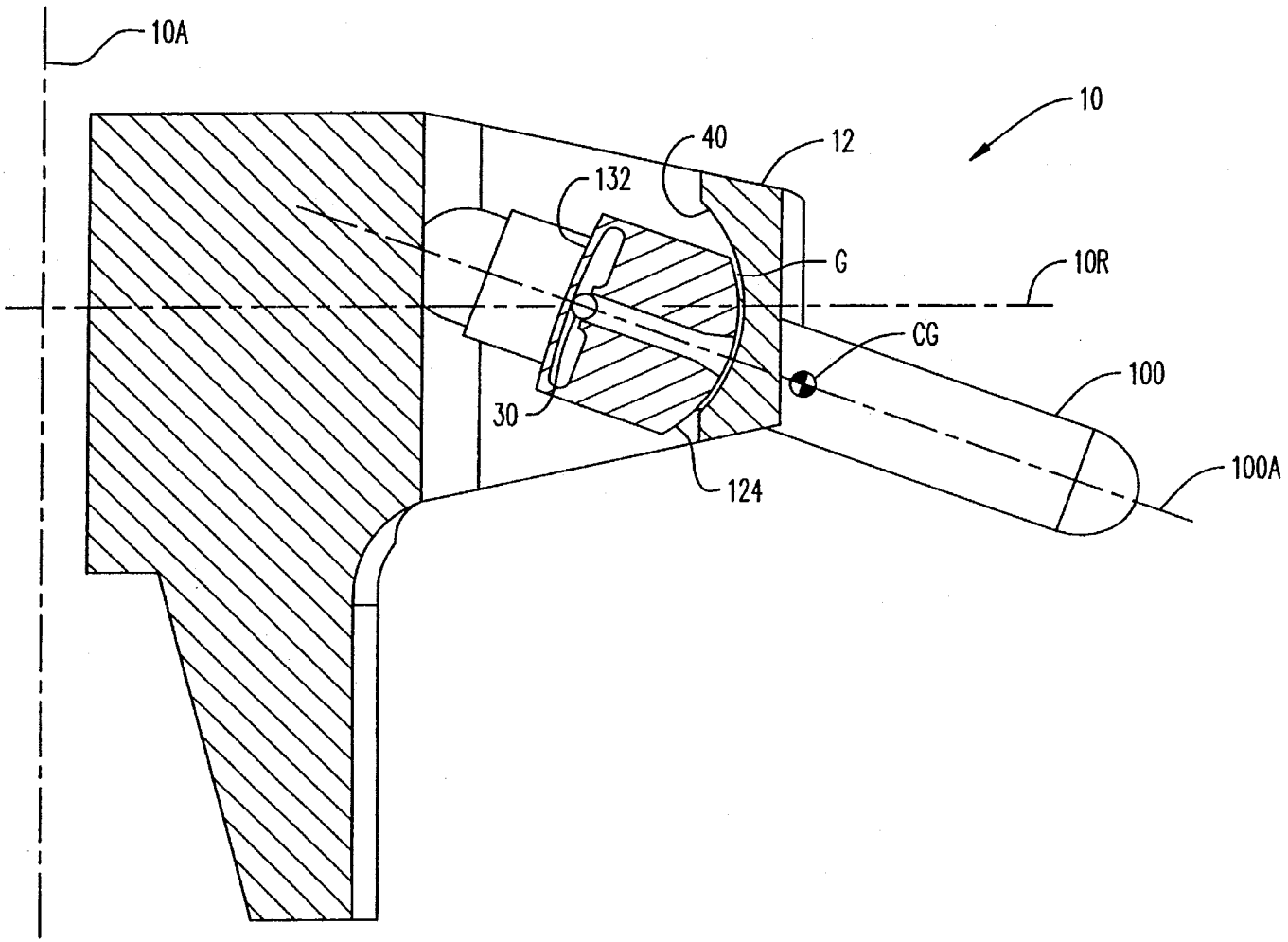
Figure 3D:
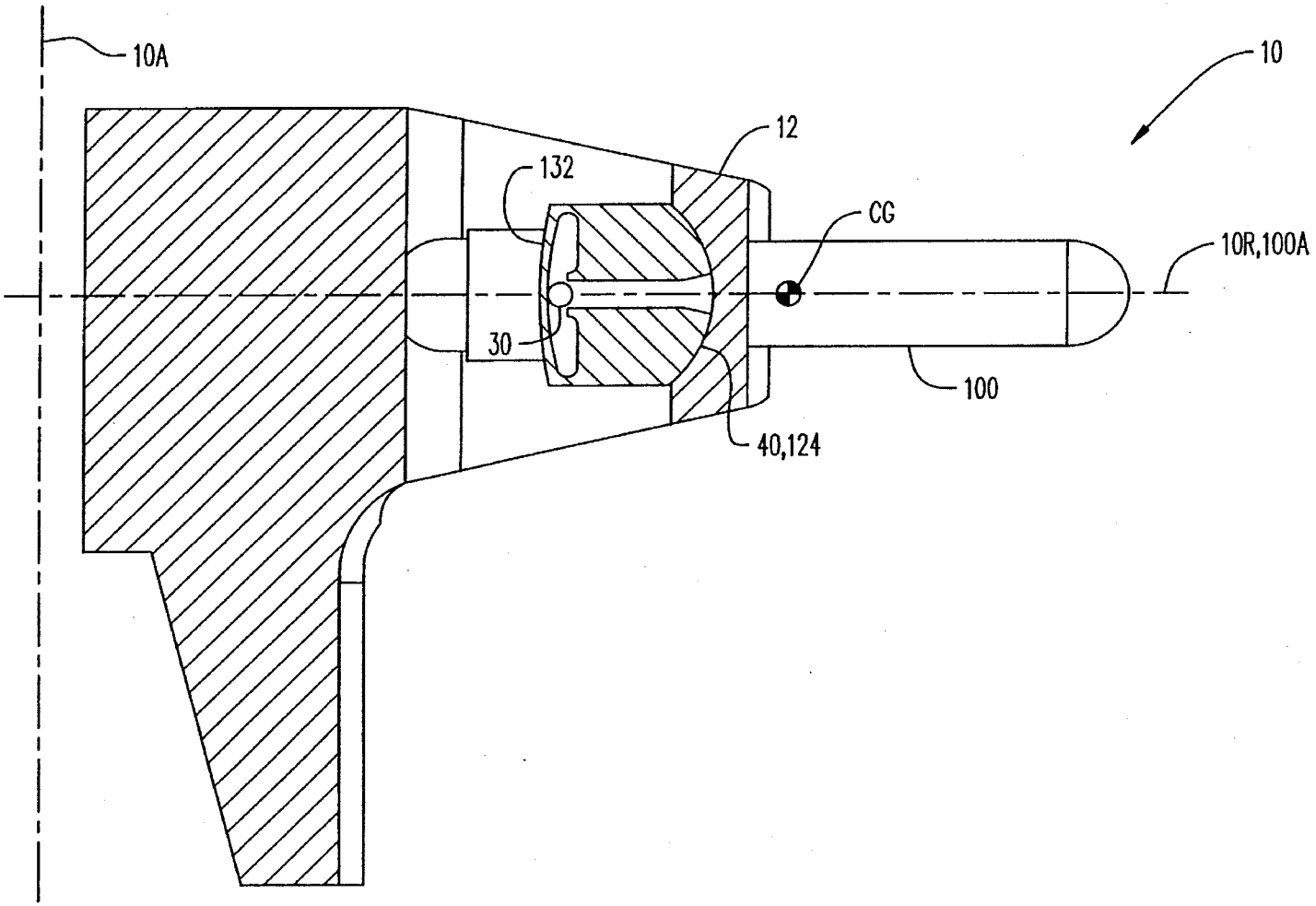

As rotor speed increases the longitudinal axis 100A of the bucket 100 approaches the horizontal reference plane 10R (FIG. 3C). Due to the centrifugal loading of the bucket 100 (and any liquid sample carried therein) the spring element 132 on each abutment 114A, 114B begins to deform. As a result the G (FIG. 3C) between the support surface 124 on each of the abutments 114A, 114B of the bucket and the support surface 40 on each sidewall 24A, 24B begins to radially narrow.

The disposition of the bucket 100 with respect to the rotor 10 when the bucket 100 has reached its operating speed is illustrated in FIG. 3D. At operating speed the longitudinal axis 100A of the bucket 100 lies substantially on the horizontal reference plane 10R of the rotor 10. The deflection of the spring element 132 on each abutment 114A, 114B deforms to an extent such that the support surface 124 on each abutment 114A, 114B contacts against the support surface 40. In particular, the portion 124T of each of support surface 124 that lies above the reference plane 10R rests against and is supported by the corresponding portion 40T of the support surface 40. In addition, in accordance with the present invention, the portion 124B of each of support surface 124 that lies below the reference plane 10R is also supported by a corresponding portion 40B of the support surface 40.

When supported by the surface 40 a substantial portion of the centrifugal load generated by the bucket 100 (and any liquid sample carried therein) is transferred from the trunnion pins 30 to the corresponding arms 16 of the rotor 10. However, since the bucket 100 is supported substantially equally both above and below the reference plane 10R no bending moments are generated in the transference of the load. This reduces the amount of material in the rotor 10 which is needed to support the load.

The relative position among the axis of generation 124A and the swing axis 100S (on the bucket 100) and the axis of generation 40A and and the line 36 (on the rotor 10) serves to define the gap G between the support surfaces 124 and 40 (FIG. 3C). In the preferred instance the axis of generation 40A and the line 36 are collinear in the plane 10R. Accordingly, the axis of generation 124A on the bucket 100 is located along the longitudinal axis 100A above the swing axis 100S. The distance between the swing axis 100S and the axis of generation 124A is usually on the order of 0.010 inch to 0.015 inch. (This distance is exaggerated in the figures for clarity of illustration.) If it is desired to have the axis of generation 124A be located along the longitudinal 100A below the swing axis 100S, then the axis of generation 40A must lie parallel to and radially outward from the line 36 in the plane 10R.

—o—O—o—

Those skilled in the art, having the benefit of the teachings of the present invention as hereinbefore set forth, may impart modifications thereto. Such modifications are to be construed as lying within the contemplation of the present invention, as defined by the appended claims.

What is claimed is:

1. A swinging bucket centrifuge rotor for use in a centrifuge instrument, the rotor comprising:

a body adapted for rotation about an axis of rotation extending vertically through the body, the body having a reference plane extending therethrough, the reference plane extending generally perpendicular to the axis of rotation, the body having at least one pair of confronting planar sidewalls, the planar sidewalls being circumferentially spaced apart to define a generally axially extending slot sized to receive a swinging bucket therein, each planar sidewall having a trunnion pin mounted thereon, each trunnion pin having an axis therethrough, the axis of each trunnion pin extending generally perpendicular to the planar sidewall on which it is mounted, the trunnion pins each being disposed a first predetermined radial distance from the axis of rotation, each sidewall further having a generally cylindrical swinging bucket support surface thereon, the cylindrical support surface being disposed on each sidewall a second, greater, radial distance from the vertical axis than said first radial distance, each cylindrical support surface having an axis of generation that lies in the reference plane, whereby a portion of each cylindrical swinging bucket support surface lies above and below the reference plane.

2. The rotor of claim 1 wherein the axis of generation of each support surface lies in parallel relationship to the axes of the trunnion pins.

3. The rotor of claim 2 wherein the axes of the trunnion pins line in the reference plane.

4. The rotor of claim 1 wherein the axis of generation of each support surface is collinear with the axes of the trunnion pins.

* * * * *